US007714828B2

(12) United States Patent
Sano

(10) Patent No.: US 7,714,828 B2
(45) **Date of Patent: *May 11, 2010**

(54) DISPLAY DEVICE HAVING A SHIFT REGISTER CAPABLE OF REDUCING THE INCREASE IN THE CURRENT CONSUMPTION

(75) Inventor: Keiichi Sano, Taipei (TW)

(73) Assignee: Sanyo Electric Co., Ltd., Osaka (JP)

( * ) Notice: Subject to any disclaimer, the term of this patent is extended or adjusted under 35 U.S.C. 154(b) by 1159 days.

This patent is subject to a terminal disclaimer.

(21) Appl. No.: 10/875,504

(22) Filed: Jun. 25, 2004

(65) Prior Publication Data

US 2005/0030274 A1 Feb. 10, 2005

(30) Foreign Application Priority Data

Jun. 27, 2003 (JP) ..... 2003-185282

(51) Int. Cl.
*G09G 3/36* (2006.01)

(52) U.S. Cl. ..... 345/100

(58) Field of Classification Search ..... 345/100; 327/94, 241; 340/825.68
See application file for complete search history.

(56) References Cited

U.S. PATENT DOCUMENTS

2002/0149318 A1* 10/2002 Jeon et al. ..... 315/169.1
2003/0128180 A1* 7/2003 Kim et al. ..... 345/100
2004/0051563 A1* 3/2004 Zhang ..... 326/115
2004/0263469 A1* 12/2004 Senda ..... 345/102

OTHER PUBLICATIONS

Kishino, Seigo, "Basis of Semiconductor Device." Ohmsha Ltd., Apr. 25, 1985, pp. 3.
"Sub-micorn Device." Jul. 31, 1997, pp. 49-51.

* cited by examiner

*Primary Examiner*—Amr Awad
*Assistant Examiner*—Yong Sim
(74) *Attorney, Agent, or Firm*—McDermott Will & Emery LLP

(57) ABSTRACT

A display capable of reducing the increase in the current consumption is disclosed. The display comprises a shift register circuit having a plurality of first circuit portions connected thereto. Each of the first circuit portions includes a first conductive type first transistor connected to a first voltage supply source, a first conductive type second transistor connected to a second voltage supply source, a first conductive type third transistor connected between the gate of the first transistor and the second potential, a first conductive type fourth transistor connected to the gate of the first transistor and turned on in response to a first signal, and a first conductive type fifth transistor connected between the fourth transistor and the first potential and turned off in response to a second signal when the first signal is for turning on the fourth transistor.

4 Claims, 11 Drawing Sheets

DISPLAY DEVICE HAVING A SHIFT REGISTER CAPABLE OF REDUCING THE INCREASE IN THE CURRENT CONSUMPTION

BACKGROUND OF THE INVENTION

1. Field of the Invention

The present invention relates to a display, or in particular to a display comprising a shift register circuit.

CROSS-REFERENCE TO RELATED APPLICATIONS

The priority application number JP2003-185282 upon which this patent application is based is hereby incorporated by reference.

2. Description of the Background Art

A conventional inverter circuit of resistance load type having a load resistance is known. This inverter circuit is disclosed in, for example, "Basics of Semiconductor Devices" by Masatake Kishino, Ohmsha Publication, Apr. 25, 1985, pp. 184 to 187.

Also, a conventional shift register circuit having the inverter circuit of resistance load type disclosed in "Basics of Semiconductor Devices" by Seigo Kishino, Ohmsha Publication, Apr. 25, 1985, pp. 184 to 187 is known. The shift register circuit is used with a circuit to drive the gate line and the drain line of a liquid crystal display or an organic EL display. FIG. 13 is a circuit diagram showing a conventional shift register circuit having an inverter circuit of resistance load type. Referring to FIG. 13 showing the conventional shift register circuit, the first-stage shift register circuit 104*a*1 is configured of a first circuit portion 104*b*1 and a second circuit portion 104*c*1. The second-stage shift register circuit 104*a*2 next to the first-stage shift register circuit 104*a*1 is comprised of a first circuit portion 104*b*2 and a second circuit portion 104*c*2.

The first circuit portion 104*b*1 includes n-channel transistors NT101, NT102, a capacitor C101 and a resistor R101. In the description of the prior art that follows, the n-channel transistors NT101, NT102, NT103 are referred to as the transistors NT101, NT102, NT103, respectively. The drain of the transistor NT101 is supplied with a start signal ST and the source thereof is connected to a node ND101. The gate of the transistor NT101 is connected with a clock signal line CLK1. The source of the transistor NT102 is connected to a lower voltage supply source (VSS), and the drain thereof is connected to a node ND102. One of the electrodes of the capacitor C101 is connected to the lower voltage supply source (VSS), and the other electrode is connected to the node ND101. A resistor R101 is inserted between the node ND102 and the higher voltage supply source (VDD). The transistor NT102 and the resistor R101 comprise an inverter circuit.

The second circuit portion 104*c*1 of the first-stage shift register circuit 104*a*1 is comprised of an inverter circuit including the transistor NT103 and the resistor R102. The source of the transistor NT103 is connected to the lower voltage supply source (VSS), and the drain thereof to a node ND103. The gate of the transistor NT103 is connected to the node ND102 of the first circuit portion 104*b*1. A resistor R102 is inserted between the node ND103 and the higher voltage supply source (VDD). An output signal SR1 of the first-stage shift register circuit 104*a*1 is output from the node ND103. The node ND103 is connected with the first circuit portion 104*b*2 of the second-stage shift register circuit 104*a*2.

The second and subsequent stages of shift register circuits are also comprised in a similar way to the first-stage shift register 104*a*1. The first circuit portion of each of the subsequent stages of the shift register circuits is connected to the output node of the immediately preceding stage of the shift register circuit.

FIG. 14 is a timing chart of the conventional shift register circuit shown in FIG. 13. Next, the operation of the conventional shift register circuit is explained with reference to FIGS. 13 and 14.

First, as an initial state, a low-level start signal ST is input. After the start signal ST goes to high, the clock signal CLK1 goes to high. As a result, the gate of the transistor NT101 of the first circuit portion 104*b*1 of the first-stage shift register circuit 104*a*1 is supplied with the high-level clock signal CLK1, and therefore the transistor NT101 is turned on. As a result, the gate of the transistor NT102 is supplied with the high-level start signal ST, and the transistor NT102 is turned on. The potential of the node ND102 goes to low, and the transistor NT103 is turned off. Since the potential of the node ND103 rises, a high-level signal is output as an output signal SR1 from the first-stage shift register circuit 104*a*1. This high-level signal is supplied also to the first circuit portion 104*b*2 of the second-stage shift register circuit 104*a*2. As long as the clock signal CLK1 remains at high level, the high-level voltage is accumulated in the capacitor C101.

Next, the clock signal CLK1 goes to low. The transistor NT101 turns off. After that, the start signal ST goes to low. At that time, even in the case where the transistor NT101 turns off, the potential of the node ND101 is held at high level by the high-level potential accumulated in the capacitor C101, and therefore the transistor NT102 is held on. The potential of the node ND102 is held at low level, and therefore the potential at the gate of the transistor NT103 is held at low level. The transistor NT103 is held off, and therefore a high-level signal is output as an output signal SR1 from the second circuit portion 104*c*1.

Next, the clock signal CLK2 input to the first circuit portion 104*b*2 of the second-stage shift register circuit 104*a*2 goes to high. The second-stage shift register circuit 104*a*2 is supplied with the high-level clock signal CLK2 while the high-level output signal SR1 is input from the first-stage shift register circuit 104*a*1. Thus, the operation similar to that of the first-stage shift register circuit 104*a*1 is performed. As a result, the high-level output signal SR2 is output from the second circuit portion 104*c*2.

After that, the clock signal CLK1 goes again to high level. The transistor NT101 of the first circuit portion 104*b*1 is turned on. At that time, the potential of the node ND101 goes to low by the fact that the start signal ST is low level. Since the transistor NT102 turns off, the potential of the node ND102 goes to high. The transistor NT103 turns on, and the potential of the node ND103 goes to low from high. The low-level output signal SR1 is output from the second circuit portion 104*c*1. As the result of this operation, the high-level output signals (SR1, SR2, SR3 and so forth) shifted in timing are sequentially output from the respective stages of the shift register circuits.

In the conventional shift register circuit shown in FIG. 13, however, the transistor NT102 is held on as long as the output signal SR1 is at high level in the first-stage shift register circuit 104*a*1, and therefore a penetration current wastefully flows between the higher voltage supply source VDD and the lower voltage supply source VSS through the resistor R101 and the transistor NT102. During the period when the output signal SR1 is at low level, on the other hand, the transistor NT103 is held on, and therefore a penetration current wastefully flows between the higher voltage supply source VDD and the lower voltage supply source VSS through the resistor R102 and the transistor NT103. As a result, whether the output signal SR1 is at high level or low level, a penetration current always flows wastefully between the higher voltage supply source VDD and the lower voltage supply source VSS. Also, other stages of the shift register circuits are configured similarly to the first-stage shift register circuit 104*a*1. Like the first-stage shift register circuit 104*a*1, therefore, a penetration current wastefully flows always between the higher voltage supply source VDD and the lower voltage supply source VSS whether the output signal is at high or low level. As a result, in the case where the conventional shift register circuit described above is used as a circuit for driving the gate line or the drain line of a liquid crystal display or an organic EL display, the problem is an increased current consumption of the liquid crystal display or the organic EL display.

SUMMARY OF THE INVENTION

The object of this invention is to provide a display capable of reducing the current consumption thereof.

In order to achieve this object, according to one aspect of the invention, there is provided a display comprising a shift register circuit formed by connecting a plurality of first circuit portions each having a first conductive type first transistor connected to a first voltage supply source, a first conductive type second transistor connected to a second voltage supply source, a first conductive type third transistor connected between the gate of the first transistor and the second voltage supply source, a first conductive type fourth transistor connected to the gate of the first transistor and adapted to turn on in response to a first signal, and a first conductive type fifth transistor connected between the fourth transistor and the first potential and turned off in response to a second signal when the first signal has the function of turning on the fourth transistor.

With the display in this aspect, the fifth transistor can be turned off when the fourth transistor is in on state, and the fifth transistor can be turned on when the fourth transistor is in off state, using the first and second signals. As a result, one of the fourth and fifth transistors is always turned off, and therefore even in the case where the third transistor connected to the second voltage supply source is in on state, a penetration current is prevented from flowing between the first and second voltage supply sources through the third, fourth and fifth transistors. As a result, the current consumption is prevented from increasing. Also, the first, second, third, fourth and fifth transistors are configured of the first conductive type, so that the number of ion implantation steps and the number of ion implantation masks used can be reduced as compared with a case in which the shift register circuit is formed of two conductive types of transistors. Thus, the manufacturing process is simplified while at the same time reducing the manufacturing cost.

DESCRIPTION OF THE PREFERRED EMBODIMENTS

Embodiments of this invention are explained below with reference to the accompanying drawings.

First Embodiment

Figure 1:
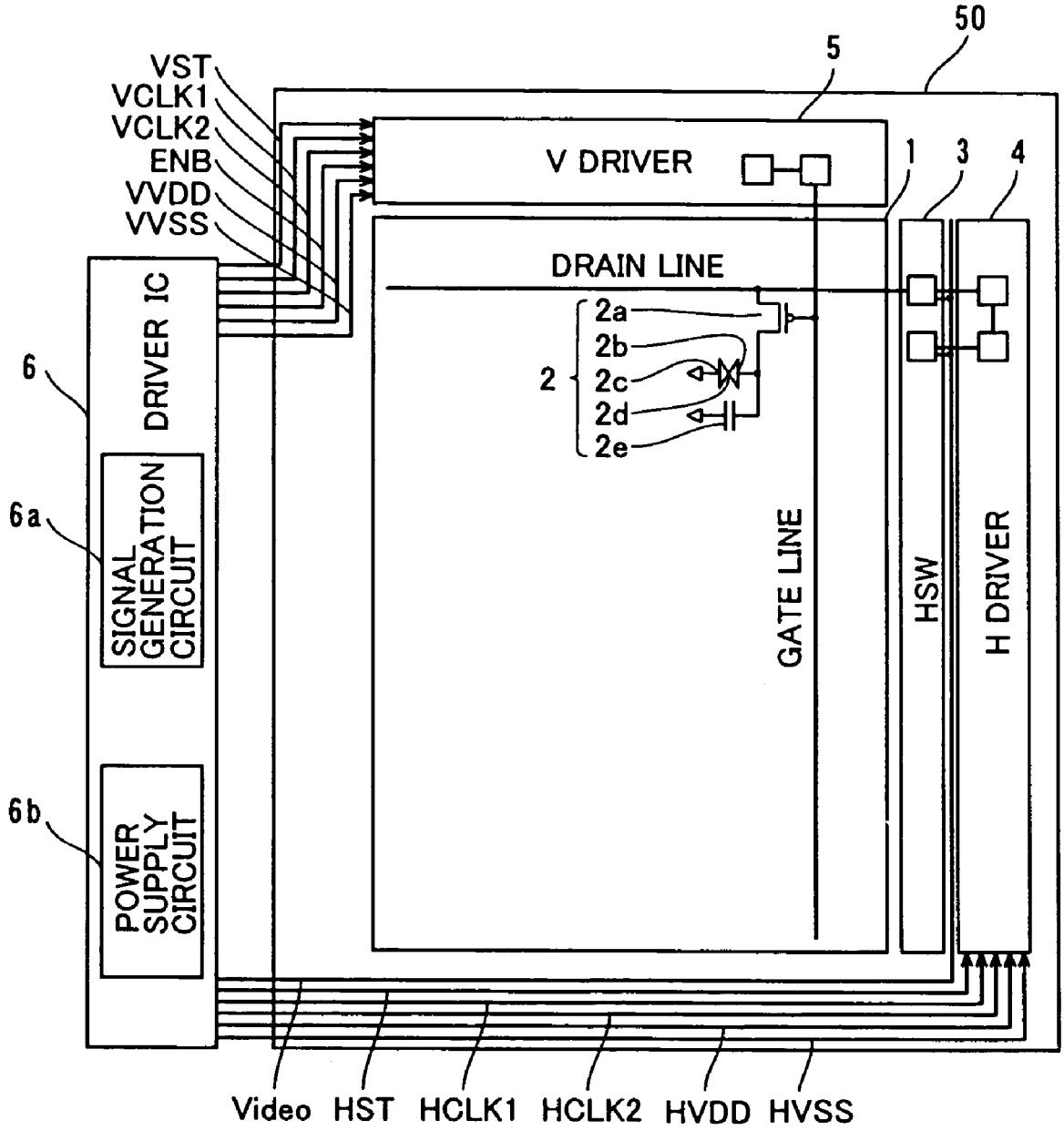
FIG. 1 is a plan view showing a liquid crystal display according to a first embodiment of the invention.

First, reference is made to FIG. 1. According to the first embodiment, a display unit 1 is arranged on a substrate 50. The display unit 1 shown in FIG. 1 represents the configuration of one pixel. This display unit 1 has a plurality of pixels 2 arranged in matrix. Each pixel 2 includes a p-channel transistor 2*a*, a pixel electrode 2*b*, a common electrode 2*c* arranged in opposed to the pixel electrode 2*b* and shared by the pixels 2, a liquid crystal 2*d* held between the pixel electrode 2*b* and the common electrode 2*c*, and a storage capacitor 2*e*. The gate of the p-channel transistor 2*a* is connected to the gate line. The drain of the p-channel transistor 2*a* is connected to the drain line. The source of the p-channel transistor 2*a* is connected with the pixel electrode 2*b* and the storage capacitor 2*e*.

A horizontal switch (HSW) 3 and a H driver 4 for driving (scanning) the drain line of the display unit 1 are arranged along one side of the display unit 1 on the substrate 50. A V driver 5 for driving (scanning) the gate line of the display unit 1 on the substrate 50 is arranged along another side of the display unit 1. Although only two HSWs are shown in FIG. 1, HSWs in the number corresponding to the number of pixels are arranged. Also, only two shift registers are shown to comprise the H driver 4 and the V driver 5. Nevertheless, the shift registers are arranged in the number corresponding to the number of pixels. A driver IC 6 is arranged outside the substrate 50. The driver IC 6 includes a signal generation circuit 6a and a power supply circuit 6*b*. A start signal HST, a clock signal HCLK, a higher voltage supply source HVDD and a lower voltage supply source HVSS are supplied from the driver IC 6 to the H driver 4. Also, a video signal Video, a start signal VST, a clock signal VCLK, an enable signal ENB, a higher voltage supply source VVDD and a lower voltage supply source VVSS are supplied from the driver IC 6 to the V driver 5.

Figure 2:
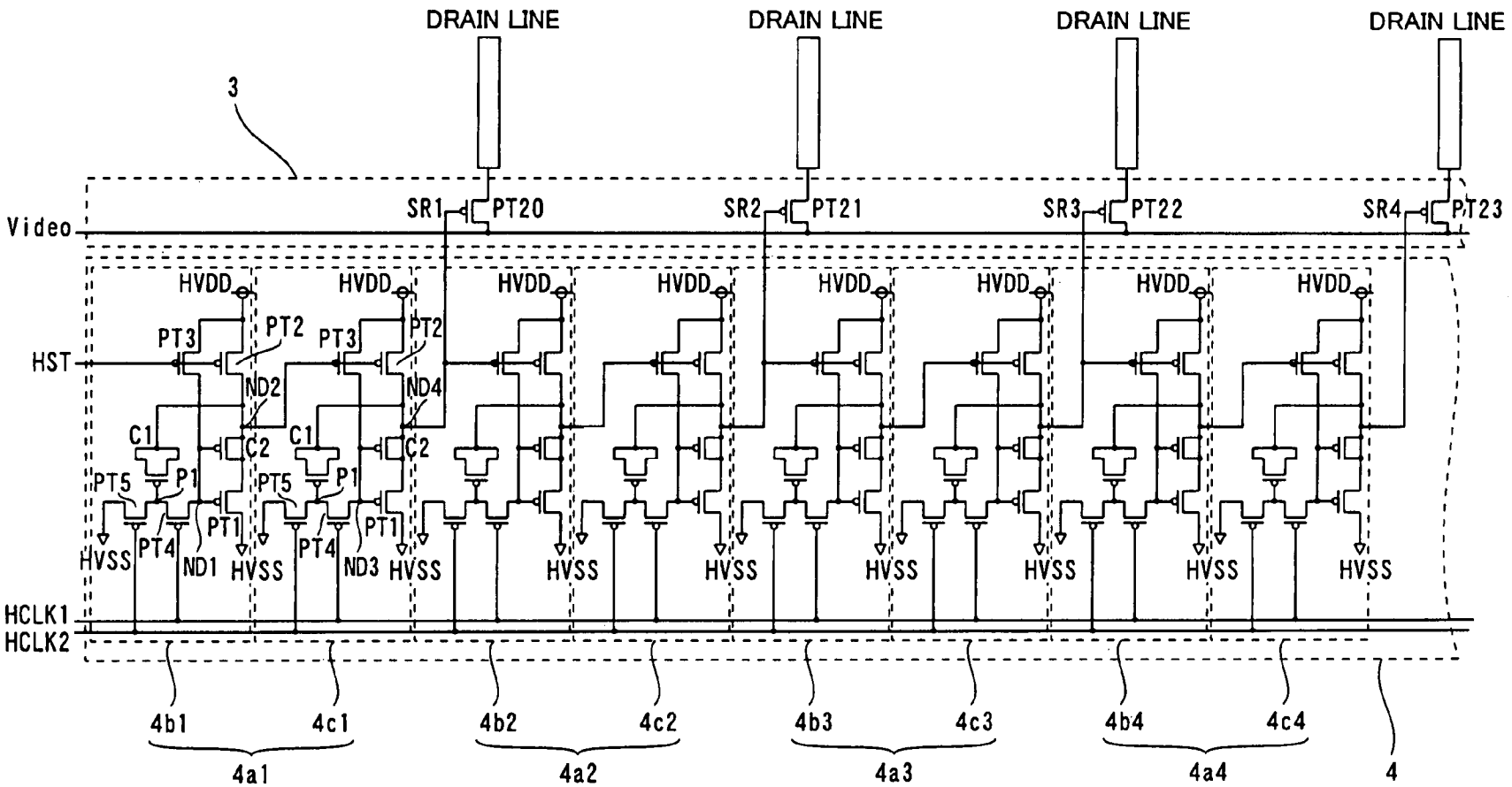
FIG. 2 is a circuit diagram of a shift register circuit making up a H driver of the liquid crystal display according to the first embodiment shown in FIG. 1.

As shown in FIG. 2, a plurality of stages of shift register circuits 4*a*1, 4*a*2, 4*a*3, 4*a*4 are arranged in the H driver 4. In FIG. 2, only four stages of shift register circuits 4*a*1, 4*a*2, 4*a*3, 4*a*4 are shown for simplicity's sake. Actually, shift registers in the number of stages corresponding to the pixels are arranged. The first-stage shift register circuit 4*a*1 is comprised of two first circuit portions 4*b*1, 4*c*1 having a similar configuration. The first circuit portions 4*b*1, 4*c*1 each include five p-channel transistors (p-channel transistors PT1, PT2, PT3, PT4, PT5) and capacitors C1, C2 formed by connecting the source and the drain of the p-channel transistors. The p-channel transistors PT1 to PT5 are hereinafter referred to as the transistors PT1 to PT5, respectively.

The transistor PT1, the transistor PT2, the transistor PT3, the transistor PT4 and the transistor PT5 are examples of "the first transistor", "the second transistor", "the third transistor", "the fourth transistor" and "the fifth transistor", respectively, according to this invention. The capacitor C1 and the capacitor C2 are examples of "the first capacitor" and "the second capacitor", respectively, according to the invention.

According to the first embodiment, the transistors PT1 to PT5 arranged in each of the first circuit portions 4*b*1, 4*c*1 and the transistors comprising the capacitors C1, C2 are all configured of TFTs (thin-film transistors) comprised of p-type MOS transistors (field-effect transistors).

In the 1st first circuit portion 4*b*1, the drain of the transistor PT1 is connected to the lower voltage supply source HVSS. The lower voltage supply source HVSS is an example of "the first potential" according to the invention. The lower voltage supply source HVSS is supplied from the driver IC 6 (FIG. 1). The source of the transistor PT1 is connected to the drain of the transistor PT2. The source of the transistor PT2 is connected to the higher voltage supply source HVDD. The higher voltage supply source HVDD is an example of "the second potential" according to the invention. The higher voltage supply source HVDD is supplied from the driver IC 6 (FIG. 1). The gate of the transistor PT2 is supplied with the start signal HST. This start signal HST is an example of "the third signal" according to the invention.

In the first embodiment, a transistor PT3 having the function of turning off the transistor PT1 when the transistor PT2 is in on state is connected between the node ND1 connected with the gate of the transistor PT1 and the higher voltage supply source HVDD. As a result, the transistor PT2 and the transistor PT1 are prevented from turning on at the same time. The gate of the transistor PT3 is supplied with the start signal HST.

According to the first embodiment, a transistor PT4 is connected between the node ND1 connected with the gate of the transistor PT1 and the lower voltage supply source HVSS. The gate of the transistor PT4 is supplied with the clock signal HCLK1. A transistor PT5 is connected between the transistor PT4 and the lower voltage supply source HVSS. The gate of the transistor PT5 is supplied with the clock signal HCLK2 which is an inverted signal of the clock signal HCLK1. The clock signal HCLK1 is an example of "the first signal" and "the first clock signal" according to the invention. The clock signal HCLK2 is an example of "the second signal" and "the second clock signal" according to the invention.

According to the first embodiment, a capacitor C1 is connected between the source of the transistor PT1 (the drain of the transistor PT2) and the junction point P1 of the transistor PT4 and the transistor PT5. A capacitor C2 is connected between the gate and the source of the transistor PT1.

The node ND2 inserted between the drain of the transistor PT2 and the source of the transistor PT1 of the 1st first circuit portion 4*b*1 is connected with the 2nd first circuit portion 4*c*1 having a similar configuration to the 1st first circuit portion 4*b*1. The node ND3 connected with the gate of the transistor PT1 of the 2nd first circuit portion 4*c*1 is arranged at a position corresponding to the node ND1 of the 1st first circuit portion 4*b*1 of the 2nd first circuit portion 4*c*1.

The output signal SR1 of the first-stage shift register circuit 4*a*1 is output from the node ND4 (output node) arranged between the source of the transistor PT1 and the drain of the transistor PT2 of the 2nd first circuit portion 4*c*1. The output signal SR1 is supplied to a horizontal switch 3. The horizontal switch 3, as shown in FIG. 2, includes a plurality of transistors PT20, PT21, PT22, PT23. In FIG. 2, only the four transistors PT20, PT21, PT22, PT23 are shown for simplicity's sake. Actually, however, transistors in the number corresponding to the number of pixels are arranged. The gates of the transistors PT20 to PT23 are connected to the outputs SR1, SR2, SR3, SR4, respectively, of the shift register circuits 4*a*1 to 4*a*4 of the first to fourth stages. The drains of the transistors PT20 to PT23 are connected to the drain lines of the respective stages. The sources of the transistors PT20 to PT23 are connected to a single video signal line Video.

The outputs SR1 to SR4 of the shift register circuits 4*a*1 to 4*a*4, respectively, are input to the sources of the horizontal switches 3 in the number corresponding to the number of the video signal lines (three in the case where three types of video signals of R, G, B are input).

The node ND4 (output node) of the first-stage shift register circuit 4*a*1 is connected with the second-stage shift register circuit 4*a*2 configured of two first circuit portions 4*b*2, 4*c*2. The output node of the second-stage shift register circuit 4*a*2 is connected with the third-stage shift register circuit 4*a*3 configured of the two first circuit portions 4*b*3, 4*c*3, while the output node of the third-stage shift register circuit 4*a*3 is connected with the fourth-stage shift register circuit 4*a*4 configured of the two first circuit portions 4*b*4, 4*c*4. The first circuit portions 4*b*2, 4*c*2 of the second-stage shift register circuit 4*a*2, the first circuit portions 4*b*3, 4*c*3 of the third-stage shift register circuit 4*a*3 and the first circuit portions 4*b*4, 4*c*4 of the fourth-stage shift register circuit 4*a*4 are configured similarly to the first circuit portions 4*b*1, 4*c*1, respectively, of the first-stage shift register circuit 4*a*1. Output signals SR2, SR3, SR4 are output from the output nodes of the second-stage shift register circuit 4*a*2, the third-stage shift register circuit 4*a*3 and the fourth-stage shift register circuit 4*a*4, respectively.

The shift register circuits of fifth and subsequent stages (not shown) are configured similarly to the first-to fourth-stage shift register circuits 4*a*1 to 4*a*4. The first circuit portion of the shift register circuit in each of subsequent stages is connected to the output node of the immediately preceding stage of the shift register circuit.

Figure 3:
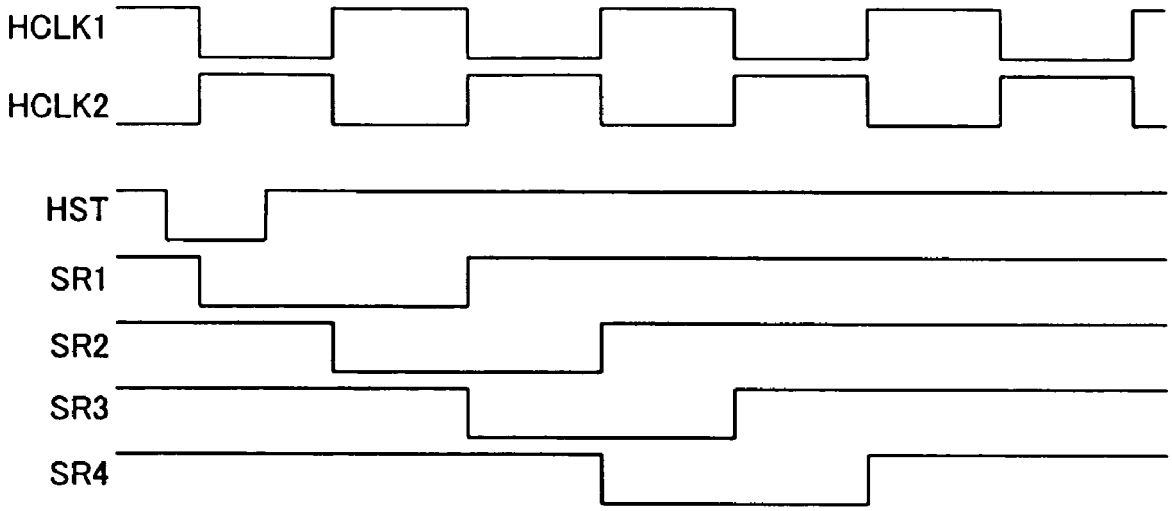
FIG. 3 is a timing chart for a shift register circuit constituting the H driver of the liquid crystal display according to the first embodiment shown in FIG. 1.

Next, the operation of the shift register circuit of the H driver of a liquid crystal display according to the first embodiment is explained with reference to FIGS. 2 and 3. In FIG. 3, reference characters SR1, SR2, SR3, SR4 designate the output signals of the first-, second-, third-and fourth-stage shift register circuits 4*a*1 to 4*a*4, respectively.

Initially, the high-level start signal HST is input to the 1st first circuit portion 4*b*1 of the first-stage shift register circuit 4*a*1. Thus, the transistor PT2 is turned off, and the potential of the node ND2 goes to low. The transistors PT2, PT3 of the 2nd first circuit portion 4*c*1 are turned on. The turning on of the transistor PT3 of the 2nd first circuit portion 4c1 goes the potential of the node ND3 to high and turns off the transistor PT1. As describe above, in the 2nd first circuit portion 4c1, the transistor PT2 is turned on while the transistor PT1 is turned off. Thus, the potential of the node ND4 goes to high. In initial state, therefore, the high-level output signal SR1 is output from the 2nd first circuit portion 4c1 of the first-stage shift register circuit 4a1.

Also, initially, in the 1st first circuit portion 4b1 and the 2nd first circuit portion 4c1, the transistor PT4 is supplied with the high-level clock signal HCLK1 and the transistor PT5 with the low-level clock signal HCLK2. In the first circuit portions 4b1, 4c1, therefore, the transistor PT4 is turned off while the transistor PT5 is turned on.

At that time, according to the first embodiment, the low-level charge is supplied through the transistor PT5 from the lower voltage supply source HVSS in the 1st first circuit portion 4b1 and the 2nd first circuit portion 4c1. At the same time, the low-level charge is accumulated in the capacitor C1 inserted between the source of the transistor PT1 and the junction point P1 of the transistors PT4 and PT5.

Under this condition, assume that the low-level start signal HST is input. The transistors PT2, PT3 of the 1st first circuit portion 4b1 are turned on. Thus, the potential of both the nodes ND1 and ND2 goes to high, and the transistor PT1 is held off. As the result of the potential of the node ND2 going to high, the transistors PT2, PT3 of the 2nd first circuit portion 4c1 turn off. At the same time, the potential of the node ND3 is held at high level, and therefore the transistor PT1 of the 2nd first circuit portion 4c1 is held in off state. Thus, the potential of the node ND4 is held at high level. As a result, the high-level output signal SR1 is output from the 2nd first circuit portion 4c1.

Next, the clock signal HCLK1 input to the transistor PT4 of the 1st first circuit portion 4b1 goes to low, while the clock signal HCLK2 input to the transistor PT5 goes to high.

At that time, according to the first embodiment, the transistor PT4 is turned on while the transistor PT5 is turned off in the 1st first circuit portion 4b1. In this case, the turning off of the transistor PT5 prevents the penetration current from flowing between the lower voltage supply source HVSS and the higher voltage supply source HVDD through the transistors PT3, PT4, PT5 of the 1st first circuit portion 4b1 even in the case that the transistors PT3, PT4 are in on state. Also, in view of the fact that the transistor PT3 of the 1st first circuit portion 4b1 is in on state, the potential of the node ND1 goes at high. Thus, the transistor PT1 of the 1st first circuit portion 4b1 is held in off state.

Also in the 2nd first circuit portion 4c1, the clock signal HCLK1 input to the transistor PT4 goes to low, while the clock signal HCLK2 input to the transistor PT5 goes to high. As a result, the transistor PT4 of the 2nd first circuit portion 4c1 is turned on while the transistor PT5 is turned off.

In the process, according to the first embodiment, the low-level charge accumulated initially in the capacitor C1 of the 2nd first circuit portion 4c1 is supplied through the transistor PT4. In view of the fact that the transistor PT3 of the 2nd first circuit portion 4c1 is in off state, the potential of the node ND3 goes to low. Thus, the transistor PT1 of the 2nd first circuit portion 4c1 is turned on.

The transistor PT2 of the 2nd first circuit portion 4c1 is in off state, and therefore the potential of the node ND4 drops to lower voltage supply source HVSS through the transistor PT1 in on state. At that time, the potential of the node ND3 goes with the potential of the node ND4 in such a manner that the gate-source voltage of the transistor PT1 is maintained by the capacitor C2 of the 2nd first circuit portion 4c1. Also, in the 2nd first circuit portion 4c1, the transistors PT3 and PT5 are in off state, and therefore the holding voltage of the capacitor C2 (the gate-source voltage of the transistor PT1) is maintained. With the decrease in the potential of the node ND4, therefore, the transistor PT1 of the 2nd first circuit portion 4c1 is kept on, so that the potential of the node ND4 providing an output potential is reduced to HVSS. As a result, the low-level output signal SR1 is output from the 2nd first circuit portion 4c1.

Next, when the start signal HST input to the 1st first circuit portion 4b1 rises to high level, the transistors PT2, PT3 of the 1st first circuit portion 4b1 turn off. In this case, the nodes ND1, ND2 are kept afloat at high level. Thus, other parts are not affected, so that the low-level output signal SR1 from the 2nd first circuit portion 4c1 is maintained.

In the 1st first circuit portion 4b1 and the 2nd first circuit portion 4c1, the clock signal HCLK1 input to the transistor PT4 goes to high, while the clock signal HCLK2 input to the transistor PT5 goes to low. In the first circuit portions 4b1, 4c1, therefore, the transistor PT4 turns off while the transistor PT5 turns on. Also in this case, the nodes ND1, ND2 are held afloat at high level. Also, the potential of the nodes ND3, ND4 is maintained at low level. Thus, the low-level output signal SR1 from the 2nd first circuit portion 4c1 is maintained.

In the process, according to the first embodiment, the 1st first circuit portion 4b1 and the 2nd first circuit portion 4c1 are such that the low-level charge is supplied from the lower voltage supply source HVSS through the transistor PT5 and accumulated in the capacitor C1 during the period when the clock signal HCLK1 is at high level and the clock signal HCLK2 is at low level.

Next, in the 1st first circuit portion 4b1, the clock signal HCLK1 input to the transistor PT4 goes to low, while the clock signal HCLK2 input to the transistor PT5 goes to high. As a result, the transistor PT4 of the 1st first circuit portion 4b1 is turned on, while the transistor PT5 is turned off.

At that time, according to the first embodiment, the low-level charge accumulated in the capacitor C1 of the 1st first circuit portion 4b1 is supplied through the transistor PT4. Since the transistor PT3 of the 1st first circuit portion 4c1 is in off state, the potential of the node ND1 goes to low. As a result, the transistor PT1 of the 1st first circuit portion 4b1 turns on. Thus, the potential of the node ND2 drops to the lower voltage supply source HVSS. In this case, the potential of the node ND1 goes with the potential of the node ND2 in such a manner that the gate-source voltage of the transistor PT1 is maintained by the capacitor C2. Also, since the transistors PT3, PT5 are in off state, the holding voltage of the capacitor C2 (the gate-source voltage of the transistor P1) is maintained. As a result, the transistor PT1 is kept on during the decrease in the potential of the node ND2, and. therefore the potential of the node ND2 goes to low to HVSS. Thus, the transistors PT2, PT3 of the 2nd first circuit portion 4c1 turn on.

The turning on of the transistor PT3 of the 2nd first circuit portion 4c1 increases the potential of the node ND3 to high level and therefore turns off the transistor PT1. As a result, the transistors PT1, PT2 of the 2nd first circuit portion 4c1 are prevented from turning on at the same time, and therefore the penetration current is prevented from flowing between the lower voltage supply source HVSS and the higher voltage supply source HVDD through the transistors PT1, PT2 of the 2nd first circuit portion 4c1.

Also in the 2nd first circuit portion 4c1, the clock signal HCLK1 input to the transistor PT4 goes to low while the clock signal HCLK2 input to the transistor PT5 goes to high.

At that time, according to the first embodiment, the transistor PT4 is turned on while the transistor PT5 is turned off in the 2nd first circuit portion 4*c*1. In this case, the turning off of the transistor PT5 prevents the penetration current from flowing between the lower voltage supply source HVSS and the higher voltage supply source HVDD through the transistors PT3, PT4, PT5 of the 2nd first circuit portion 4*c*1.

The transistor PT2 is turned on while the transistor PT1 is turned off in the 2nd first circuit portion 4*c*1, so that the potential of the node ND4 goes to high to HVDD from HVSS. As a result, the high-level output signal SR1 is output from the 2nd first circuit portion 4*c*1.

As described above, the first-stage shift register circuit 4*a*1 is such that in the case where the low-level start signal HST is input to the 1st first circuit portion 4*b*1, the low-level clock signal HCLK1 and the high-level clock signal HCLK2 are input, so that the low-level output signal SR1 is output from the 2nd first circuit portion 4*c*1. After that, the input clock signal HCLK1 goes to high, while the clock signal HCLK2 goes to low. In the case that the clock signal HCLK1 goes to low again while the clock signal HCLK2 goes to high subsequently, the output signal SR1 of the 2nd first circuit portion 4*c*1 goes to high.

The output signal SR1 of the 2nd first circuit portion 4*c*1 is input to the 1st first circuit portion 4*b*2. In the second-stage shift register circuit 4*a*2, assume that the low-level output signal SR1 of the first-stage shift register circuit 4*a*1 is input to the 1st first circuit portion 4*b*2 while the high-level clock signal HCLK1 and the low-level clock signal HCLK2 are input. The low-level output signal SR2 is output from the 2nd first circuit portion 4*c*2. Further, in the third-stage shift register circuit 4*a*3, assume that the low-level output signal SR2 of the second-stage shift register circuit 4*a*2 is input to the 1st first circuit portion 4*b*3 while the low-level clock signal HCLK1 and the high-level clock signal HCLK2 are input. Then, the low-level output signal SR3 is output from the 2nd first circuit portion 4*c*3. In this way, the low-level output signal of the shift register circuit in the preceding stage is input to the shift register circuit in the next stage, while the clock signals HCLK1 and HCLK2 are input to the shift register circuit of each stage. Thus, the low-level output signals are sequentially output at different timings from the shift register circuits of the respective stages.

The low-level signals shifted in timing are input to the gates of the transistors PT20, PT21, PT22, PT23 of the horizontal switch 3. Thus, the transistors PT20, PT21, PT22, PT23 are sequentially turned on. As a result, the video signal is supplied from the video signal line Video to the drain line in each stage, and thus the drain lines of the respective stages are sequentially driven (scanned). Upon complete scanning of the drain lines of all the stages connected to one gate line, the next gate line is selected. After the drain lines of the respective stages are sequentially scanned, the next gate line is selected again. This operation is repeated until the end of scanning the drain line of each stage connected to the last gate line thereby to complete the scanning of one screen.

The first embodiment, as described above, comprises the transistor PT4 connected to the gate of the transistor PT1 and turned on in response to the clock signal HCLK1 and the transistor PT5 connected between the transistor PT4 and the lower voltage supply source HVSS and turned on in response to the clock signal HCLK2 providing an inverted signal of the clock signal HCLK1. Thus, the transistor PT5 can be turned off while the transistor PT4 is in on state on the one hand, and the transistor PT5 can be turned on while the transistor PT4 is in off state on the other hand, using the clock signal HCLK1 and the clock signal HCLK2. As a result, one of the transistors PT4, PT5 is kept off. Even in the case where the transistor PT3 connected to the higher voltage supply source HVDD is in on state, therefore, the penetration current is prevented from flowing between the lower voltage supply source HVSS and the higher voltage supply source HVDD through the transistors PT3, PT4, PT5. Thus, the current consumption of the liquid crystal display can be prevented from increasing.

According to the first embodiment, the transistors PT1 to PT5 and the transistors comprising the capacitors C1, C2 of the two first circuit portions 4*b*1, 4*c*1 are formed of TFTs (thin-film transistors) as p-type MOS transistors (field-effect transistors). As compared with a case in which a shift register circuit includes two conduction types of transistors, therefore, the number of ion implantation steps and the number of ion implantation masks can be reduced. As a result, the manufacturing process is simplified while at the same time reducing the manufacturing cost. Also, the manufacturing process is simplified even more by reason of the fact that the p-type field-effect transistor, unlike the n-type field-effect transistor, requires no LDD (lightly doped drain) structure.

According to the first embodiment, the capacitor C1 is inserted between the source of the transistor PT1 and the junction point P1 of the transistor PT4 and the transistor PT5. Therefore, the low-level charge supplied from the lower voltage supply source HVSS during the period when the transistor PT5 is in on state can be accumulated in the capacitor C1. Subsequently when the transistor PT4 is turned on while the transistor PT5 is turned off, the transistor PT1 can be turned on by the low-level charge accumulated in the capacitor C1.

Second Embodiment

Figure 4:
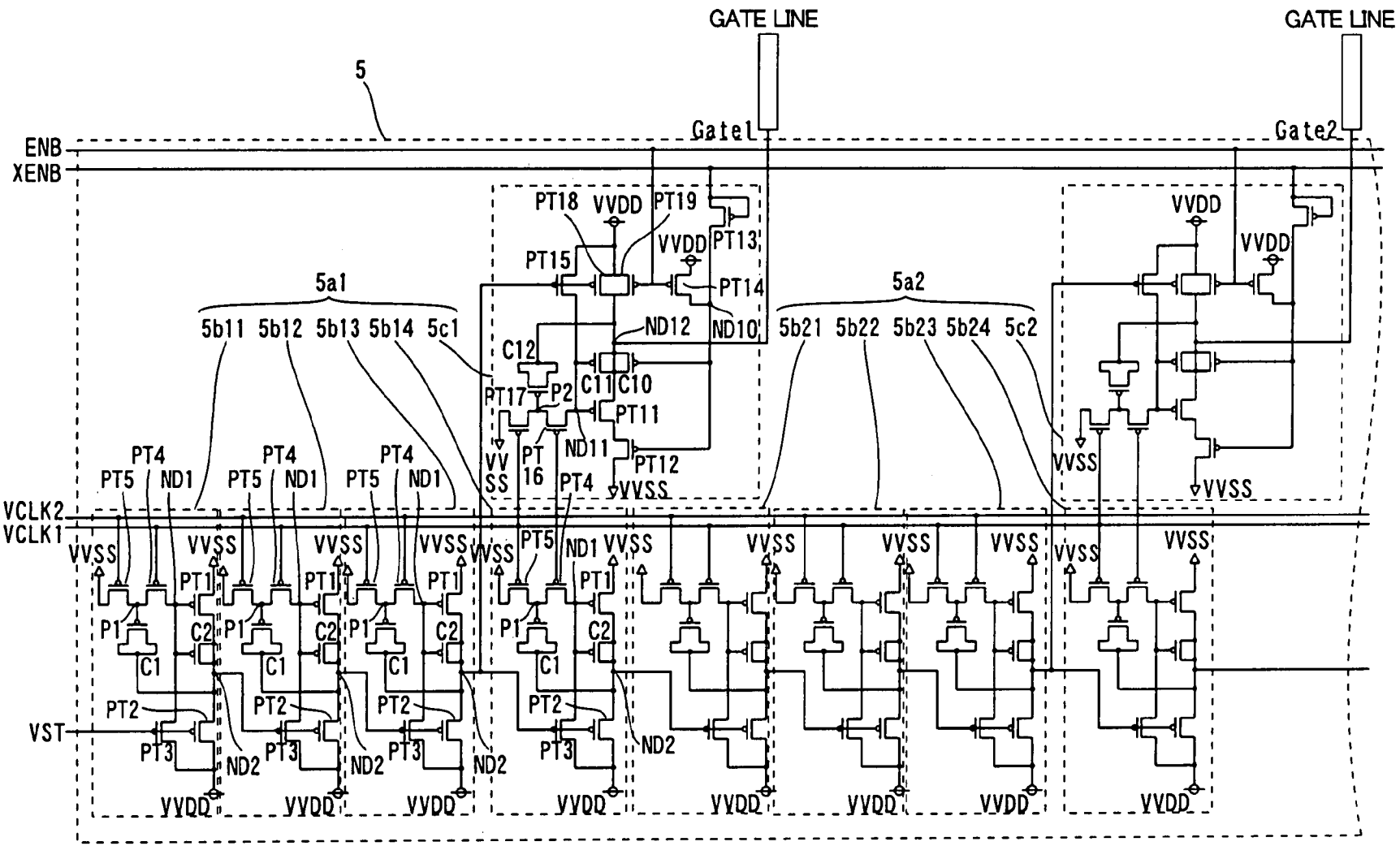
FIG. 4 is a circuit diagram showing a shift register circuit comprising the V driver of the liquid crystal display according to a second embodiment of the invention.

Reference is made to FIG. 4. The second embodiment of the invention, unlike the first embodiment described above, is explained with reference to a case using a V driver for driving (scanning) the gate line.

Specifically, the V driver 5 of the liquid crystal display according to the second embodiment comprises a plurality of stages of shift register circuits 5*a*1, 5*a*2 as shown in FIG. 4. In FIG. 4, only two stages of the shift register circuits 5*a*1, 5*a*2 are shown for simplicity's sake. Actually, a plurality of stages of the shift register circuits in the number corresponding to the number of pixels are provided. The first-stage shift register circuit 5*a*1 is configured of first circuit portions 5*b*11, 5*b*12, 5*b*13, 5*b*14 and a second circuit portion 5*c*1. The first circuit portions 5*b*11, 5*b*12, 5*b*13, 5*b*14 all have a similar configuration. The first circuit portion 5*b*11, on the other hand, is configured of five p-channel transistors (p-channel transistors PT1, PT2, PT3, PT4, PT5) and capacitors C1 and C2 formed by connecting the source and the drain of the p-channel transistors. The second circuit portion 5*c*1 is comprised of nine p-channel transistors (p-channel transistors PT11, PT12, PT13, PT14, PT15, PT16, PT17, PT18, PT19) and capacitors C10, C11, C12 formed by connecting the source and the drain of the p-channel transistors. The p-channel transistors PT18, PT19 have the sources and the drains thereof connected to each other. The p-channel transistors PT1 to PT5 and PT11 to PT19 are hereinafter referred to as the transistors PT1 to PT5 and PT11 to PT19, respectively.

The transistors PT11, PT12, PT13, PT14, PT15, PT16, PT17, PT18, PT19 are an example of "the sixth transistor", "the 12th transistor", "the 13th transistor", "the eighth transistor", "the ninth transistor", "the tenth transistor", "the seventh transistor" and "the 11th transistor", respectively, according to the invention.

According to the second embodiment, the transistors PT1 to PT5, PT11 to PT19 and the transistors comprising the capacitors C1, C2, C10, C11, C12 of the first circuit portion 5b11 and the second circuit portion 5c1 are all TFTs (thin-film transistors) formed of p-type MOS transistors (field-effect transistors).

In the first circuit portion 5b11, the drain of the transistor PT1 is connected to the lower voltage supply source VVSS. The source of the transistor PT1 is connected to the drain of the transistor PT2. The source of the transistor PT2 is connected to the higher voltage supply source VVDD. The gate of the transistor PT2 is supplied with the start signal VST.

According to the second embodiment, the transistor PT3 having the function of turning off the transistor PT1 when the transistor PT2 is in on state is connected between the higher voltage supply source VVDD and the node ND1 connected with the gate of the transistor PT1. As a result, the transistor PT2 and the transistor PT1 are prevented from turning on at the same time. The gate of the transistor PT3 is supplied with the start signal VST.

According to the second embodiment, the transistor PT4 is connected between the lower voltage supply source VVSS and the node ND1 connected with the gate of the transistor PT1. The gate of the transistor PT4 is supplied with the clock signal VCLK1. The transistor PT5 is connected between the transistor PT4 and the lower voltage supply source VVSS. The gate of the transistor PT5 is supplied with the clock signal VCLK2 providing an inverted signal of the clock signal VCLK1. The clock signal VCLK1 and the clock signal VCLK2 are generated from a single clock signal. The clock signal VCLK1 is an example of "the first signal" and "the first clock signal" according to the invention. The clock signal VCLK2, on the other hand, provides an example of "the second signal" and "the second clock signal" according to the invention.

According to the second embodiment, the capacitor C1 is inserted between the source of the transistor PT1 and the junction point P1 of the transistors PT4 and PT5. Also, the capacitor C2 is connected between the gate and the source of the transistor PT1.

The first circuit portions 5b12, 5b13, 5b14 having a similar configuration to the first circuit portion 5b11 are connected in series to each other. The node ND2 of the 3rd first circuit portion 5b13 is connected to the second circuit portion 5c1.

In the second circuit portion 5c1, the drain of the transistor PT11 is connected to the source of the transistor PT12. The drain of the transistor PT12 is connected to the lower voltage supply source VVSS. The gate of the transistor PT12 is connected to the XENB signal line (inverted enable signal line) through the transistor PT13. The diode connection is effected between the gate and the drain of the transistor PT13. The node ND10 inserted between the gate of the transistor PT12 and the transistor PT13 is connected with the drain of the transistor PT14. The source of the transistor PT14 is connected to the higher voltage supply source VVDD. The gate of the transistor PT14 is connected to the ENB signal line (enable signal line). The ENB signal supplied from the ENB signal line provides an example of "the fourth signal" according to the invention. A capacitor C10 is connected between the gate and the source of the transistor PT12.

The source of the transistor PT11 is connected to the drain of the transistors PT18, PT19. The source of the transistors PT18, PT19 is connected to the higher voltage supply source WDD. The gate of the transistor PT18 is connected to the node ND2 of the 3rd first circuit portion 5b13. The gate of the transistor PT19 is connected to the ENB signal line.

A transistor PT15 is inserted between the higher voltage supply source VVDD and the node ND11 connected with the gate of the transistor PT11. The gate of the transistor PT15 is connected to the node ND2 of the 3rd first circuit portion 5b13. The capacitor C11 is inserted between the gate and the source of the transistor PT11. A transistor PT16 is connected between the lower voltage supply source VVSS and the node ND11 connected with the gate of the transistor PT11. The gate of the transistor PT16 is supplied with the clock signal VCLK2. A transistor PT17 is connected between the transistor PT16 and the lower voltage supply source VVSS. The gate of the transistor PT17 is supplied with the clock signal VCLK1. The capacitor C12 is interposed between the source of the transistor PT11 and the junction point P2 of the transistor PT16 and the transistor PT17.

An output signal Gate1 of the first-stage shift register circuit 5a1 is output from the node ND12 (output node) interposed between the source of the transistor PT11 and the drain of the transistors PT18, PT19. The node ND12 is connected with the gate line.

The node ND2 of the 3rd first circuit portion 5b13 is also connected with the 4th first circuit portion 5b14. The node ND12 of the 4th first circuit portion 5b14 is connected with the first circuit portion 5b21 of the second-stage shift register circuit 5a2. The second-stage shift register circuit 5a2 is configured of the first circuit portions 5b21, 5b22, 5b23, 5b24 and the second circuit portion 5c2. The first circuit portions 5b21, 5b22, 5b23, 5b24 and the second circuit portion 5c2 of the second-stage shift register circuit 5a2 are configured in a similar way to the first circuit portions 5b11, 5b12, 5b13, 51b14 and the second circuit portion 5c1 of the first-stage shift register circuit 5a1.

An output signal Gate2 is output from the output node of the second-stage shift register circuit 5a2. The output node of the second-stage shift register circuit 5a2 is connected to the gate line. The 4th first circuit portion 5b24 is connected with the first circuit portion of the third-stage shift register circuit (not shown). The third and subsequent stages of the shift register circuits are configured in a similar way to the first-stage shift register circuit 5a1.

Figure 5:
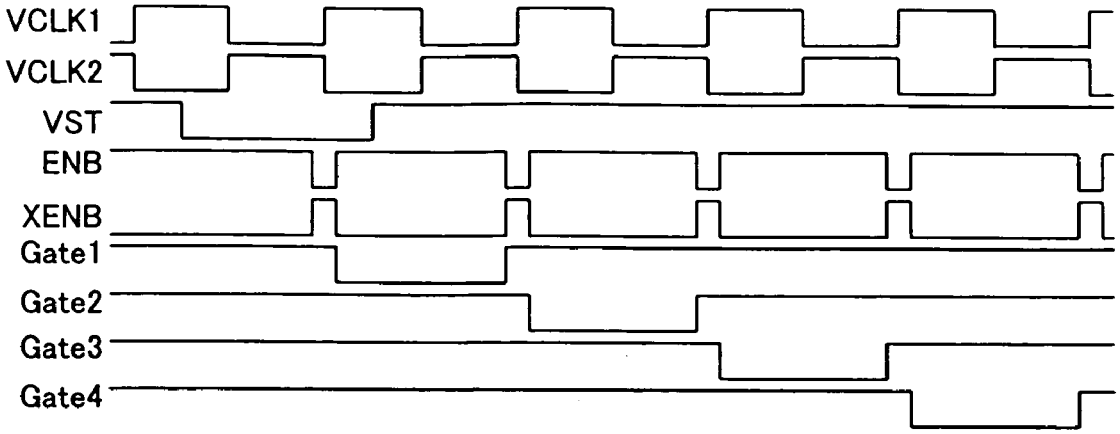
FIG. 5 is a timing chart for the shift register circuit constituting the V driver of the liquid crystal display according to the second embodiment shown in FIG. 4.

Next, with reference to FIGS. 4 and 5, the operation of the shift register circuit of the V driver of the liquid crystal display according to the second embodiment is explained. In FIG. 5, reference characters Gate1, Gate 2, Gate3, Gate4 designate the output signals output to the gate line from the shift register circuits in the first to fourth stages, respectively.

The configuration of the first circuit portions 5b11, 5b12 of the first-stage shift register circuit 5a1 of the V driver 5 according to the second embodiment is similar to that of the first circuit portions 4b1, 4c1 of the shift register circuit 4a1 according to the first embodiment. Thus, the operation of the first circuit portions 5b11, 5b12 of the shift register circuit 5a1 according to the second embodiment performed in response to the start signal VST, the clock signal VCLK1 and the clock signal VCLK2 is similar to the operation of the first circuit portions 4b1, 4c1 of the shift register circuit 4a1 performed in response to the start signal HST, the clock signals HCLK1 and the HCLK2 according to the first embodiment shown in FIG. 2.

Specifically, as an initial state, the high-level start signal VST is input to the first circuit portion 5b11 of the first-stage shift register circuit 5a1. By the same operation as the H driver according to the first embodiment described above, a high-level signal is output from the 2nd first circuit portion 5b12. This high-level signal is input to the gates of the transistors PT2, PT3 of the 3rd first circuit portion 5b13. As a result, the transistors PT2, PT3 are turned off, and therefore a low-level signal is output from the 3rd first circuit portion 5b13.

The low-level output signal from the 3rd first circuit portion 5b13 is input to the gate of the transistor PT15 and the gate of the transistor PT18 of the second circuit portion 5c1. Thus, the transistors PT15, PT18 are turned on. Thus, the potential of the node ND12 goes to high. In the initial state, therefore, a high-level output signal Gate1 is output to the gate line from the first-stage shift register circuit 5a1.

Under this condition, assume that the low-level start signal VST is input. A high-level signal is output from the 2nd first circuit portion 5b12 by the operation similar to the H driver according to the first embodiment. Like in the initial state, therefore, the high-level output signal Gate1 continues to be output to the gate line from the first-stage shift register circuit 5a1.

Next, assume that the low-level clock signal VCLK1 and the high-level clock signal VCLK2 are input. By the operation similar to that of the H driver according to the first embodiment, a low-level signal is output from the 2nd first circuit portion 5b12. This low-level signal is input to the gates of the transistors PT2, PT3 of the 3rd first circuit portion 5b13, and therefore the transistors PT2, PT3 of the 3rd first circuit portion 5b13 are turned on. At that time, the transistor PT1 of the 3rd first circuit portion 5b13 is in off state, and therefore a high-level signal is output from the 3rd first circuit portion 5b13. This high-level signal is input to the gate of the transistor PT15 and the gate of the transistor PT18 of the second circuit portion 5c1. At the same time, the ENB signal is held at high level, and therefore the transistors PT18, PT19 are turned off. Also, since the node ND11 is kept afloat at high level, the transistor PT11 is also kept off. As a result, the high-level output signal Gate1 continues to be output to the gate line from the first-stage shift register circuit 5a1.

Next, the ENB signal drops to low level and the XENB signal goes to high. As a result, the transistor PT19 supplied with the low-level ENB signal is turned on. The low-level ENB signal is input also to the gate of the transistor PT14, and therefore the transistor PT14 is turned on. Thus, the potential of the node ND10 goes to high, and therefore the transistor PT12 with the gate thereof connected to the node ND10 is turned off. The potential of the node ND12 goes to high, and therefore the high-level output signal Gate1 continues to be output to the gate line from the first-stage shift register circuit 5a1.

Next, with the ENB signal at low level, the high-level clock signal VCLK1 is input to the transistor PT5 and the low-level clock signal VCLK2 is input to the transistor PT4 in the 3rd first circuit portion 5b13. As a result, the transistor PT5 of the 3rd first circuit portion 5b13 turns off while the transistor PT4 turns on. The low-level charge accumulated in the capacitor C1 of the 3rd first circuit portion 5b13 is supplied through the transistor PT4. Since the transistors PT2, PT3 of the 3rd first circuit portion 5b13 are in on state, the potential of the node ND1 of the 3rd first circuit portion 5b13 is held at high level. The transistor PT1 of the 3rd first circuit portion 5b13 is turned off, and therefore a high-level signal is output from the 3rd first circuit portion 5b13. This high-level signal is input to the gate of the transistor PT15 and the gate of the transistor PT18 of the second circuit portion 5c1. The transistor PT15 is held in off state. Since the gate of the transistor PT19 is supplied with the low-level ENB signal, in contrast, the transistor PT19 is held in on state.

Also in the second circuit portion 5c1, the high-level clock signal VCLK1 is input to the transistor PT17 and the low-level clock signal VCLK2 to the transistor PT16. Thus, the transistor PT17 is turned off while turning on the transistor PT16. As a result, the low-level charge that has been accumulated in the capacitor C12 of the second circuit portion 5c1 is supplied through the transistor PT16. The potential of the node ND11 goes to low, and therefore the transistor PT11 is turned on. In this case, however, the ENB signal is at low level and therefore the transistor PT14 is held in on state. Thus, the transistor PT12 is held in off state, with the result that the node ND12 is held at high level. Under this condition, the output signal Gate1 to the gate line from the first-stage shift register circuit 5a1 is held at high level.

After that, the ENB signal goes to high and the XENB signal goes to low, so that the transistors PT19, PT14 are turned off. Also, the transistor PT12 supplied with the low-level XENB signal to the gate thereof through the transistor PT13 is turned on. Therefore, the transistors PT11, PT12 are turned on, while the transistor PT19 is turned off. Thus, the potential of the node ND12 goes to low VVSS due to the function of the capacitor C11. As a result, the low-level output signal Gate1 is output to the gate line from the first-stage shift register circuit 5a1.

Under this condition, assume that the start signal VST goes to high. A low-level signal is output from the 2nd first circuit portion 5b12 by the operation similar to that of the H driver according to the first embodiment. As a result, a high-level signal continues to be output from the 3rd first circuit portion 5b13. Thus, the high-level output signal Gate1 continues to be output from the first-stage shift register circuit 5a1 to the gate line.

Further, under this condition, assume that the clock signal VCLK1 goes to low, while the clock signal VCLK2 is goes to high. The node ND11 is held afloat at low level, and therefore the transistor PT11 is held in on state. As a result, the output signal Gate1 from the first-stage shift register 5a1 to the gate line is held at low level.

The turning the ENB signal to low level and the XENB signal to high level turns on the transistors PT19, PT14. The turning on of the transistor PT14 turns the potential of the node ND10 to high level. As a result, the transistor PT12 with the gate thereof connected to the node ND10 is turned off. The transistor PT19 is turned on while the transistor PT12 is turned off, thereby raising the potential of the node ND12 to high level. Thus, the high-level output signal Gate1 is output to the gate line from the first-stage shift register circuit 5a1.

The output signal from the 3rd first circuit portion 5b13 of the first-stage shift register circuit 5a1 is input also to the 4th first circuit portion 5b14. This 4th first circuit portion 5b14 is configured similarly to the first circuit portion 5b13, and therefore operates in a similar way to the first circuit portion 5b13 in response to an input signal. Specifically, once a high-level signal is input from the 3rd first circuit portion 5b13, the 4th first circuit portion 5b14 outputs a low-level signal. In the case where a low-level signal is input from the 3rd first circuit portion 5b13, on the other hand, the 4th first circuit portion 5b14 outputs a high-level signal. The output signal from the 4th first circuit portion 5b14 of the first-stage shift register 5a1 is input to the first circuit portion 5b21 of the second-stage shift register circuit 5a2. The shift register circuits in the second and subsequent stages operate in a similar way to the first-stage shift register circuit 5a1 due to the output signal from the 4th first circuit portion of the shift register circuit in the preceding stage, the clock signal VCLK1, the clock signal VCLK2, the ENB signal and the XENB signal. Thus, the gate lines in the respective stages are sequentially driven (scanned). In this case, the output of the shift register circuit is forcibly held at high level during the period when the ENB signal is at low level. By keeping the ENB signal at low level at the timing shown in FIG. 5, therefore, the low-level output signals of the shift register circuits in the preceding and following stages are prevented from being superposed one on the other.

The second embodiment, as described above, comprises the transistor PT4 connected to the gate of the transistor PT1 and turned on in response to the clock signal HCLK1 and the transistor PT5 connected between the transistor PT4 and the lower voltage supply source VVSS and turned on in response to the clock signal HCLK2 providing an inverted signal of the clock signal HCLK1. Using the clock signal HCLK1 and the clock signal HCLK2, therefore, the transistor PT5 can be turned off while the transistor PT4 is in on state on the one hand and the transistor PT5 can be turned on while the transistor PT4 is in off state on the other hand. As a result, one of the transistors PT4 and PT5 is kept in off state. Even in the case that the transistor PT3 connected to the higher voltage supply source VVDD is in on state, therefore, the penetration current is prevented from flowing between the lower voltage supply source VVSS and the higher voltage supply source VVDD through the transistors PT3, PT4, PT5. As a consequence, the current consumption of the liquid crystal display is prevented from increasing.

The other effects of the second embodiment are similar to those of the first embodiment.

Third Embodiment

The third embodiment represents a case in which the H driver for driving (scanning) the drain line is configured of an n-channel transistor.

Figure 6:
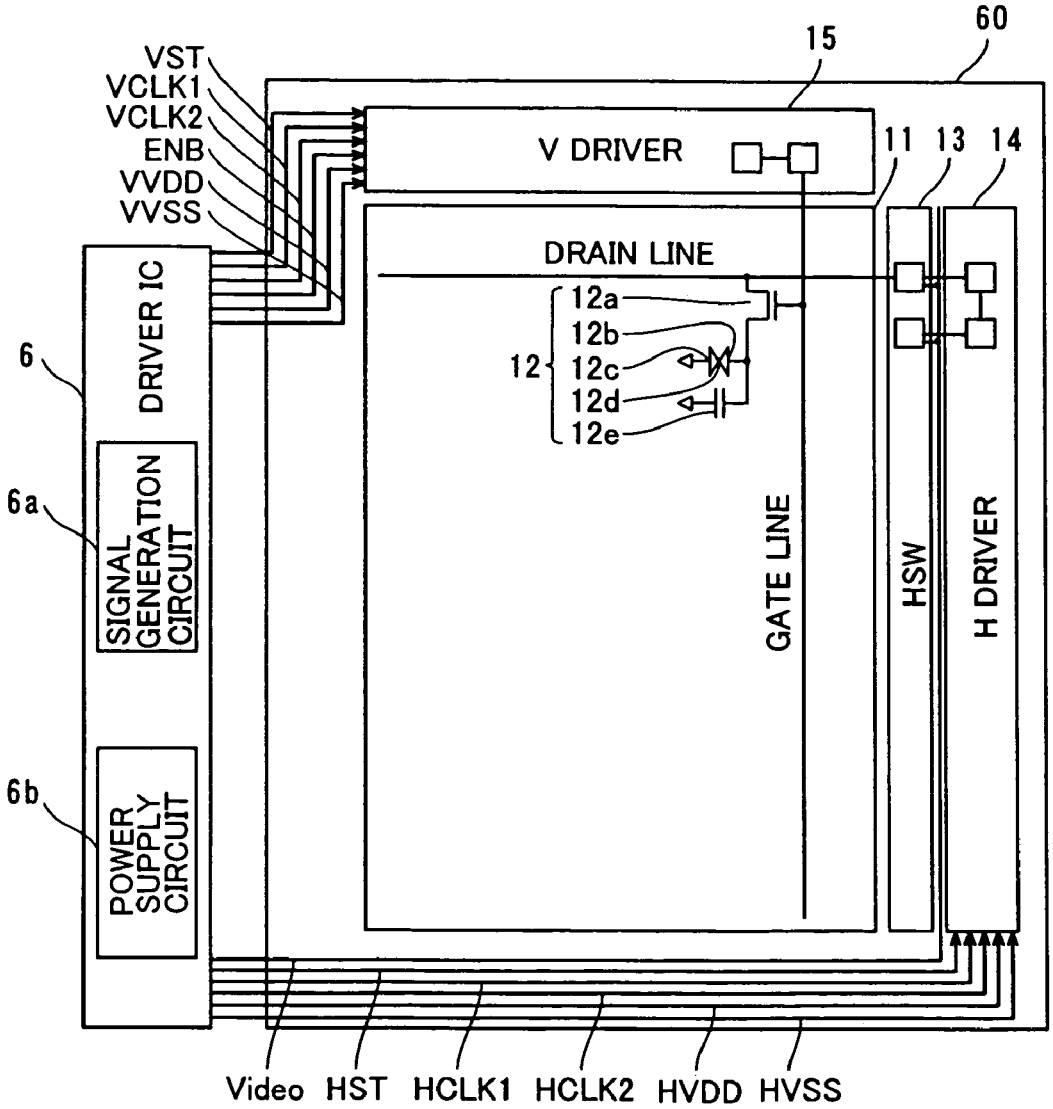
FIG. 6 is a plan view showing a liquid crystal display according to a third embodiment of the invention.

First, reference is made to FIG. 6. The liquid crystal display according to the third embodiment comprises a display unit 11 arranged on a substrate 60. The display unit 11 shown in FIG. 6 represents the configuration of one pixel. Each of the pixels 12 arranged in matrix on the display unit 11 is configured of an n-channel transistor 12*a*, a pixel electrode 12*b*, an electrode 12*c* arranged in opposed relation to the pixel electrode 12*b* and shared by the pixels 12, a liquid crystal 12*d* held between the pixel electrode 12*b* and the opposed electrode 12*c* and an storage capacitor 12*e*. The gate of the n-channel transistor 12*a* is connected to the gate line. The drain of the n-channel transistor 12*a* is connected to the drain line. The source of the n-channel transistor 12*a* is connected to the pixel electrode 12*b* and the storage capacitor 12*e*. A horizontal switch (HSW) 13 and a H driver 14 for driving (scanning) the drain line of the display unit 11 are arranged along one side of the display unit 11 on the substrate 60. A V driver 15 for driving (scanning) the gate line of the display unit 11 is arranged on the substrate 60 along another side of the display unit 11. In FIG. 6, only two HSWs are shown. Nevertheless, HSWs in the number corresponding to the number of the pixels are actually arranged. Also, only two shift registers are shown to make up the H driver 14 and the V driver 15, and shift registers in the number corresponding to the number of the pixels are actually arranged.

Figure 7:
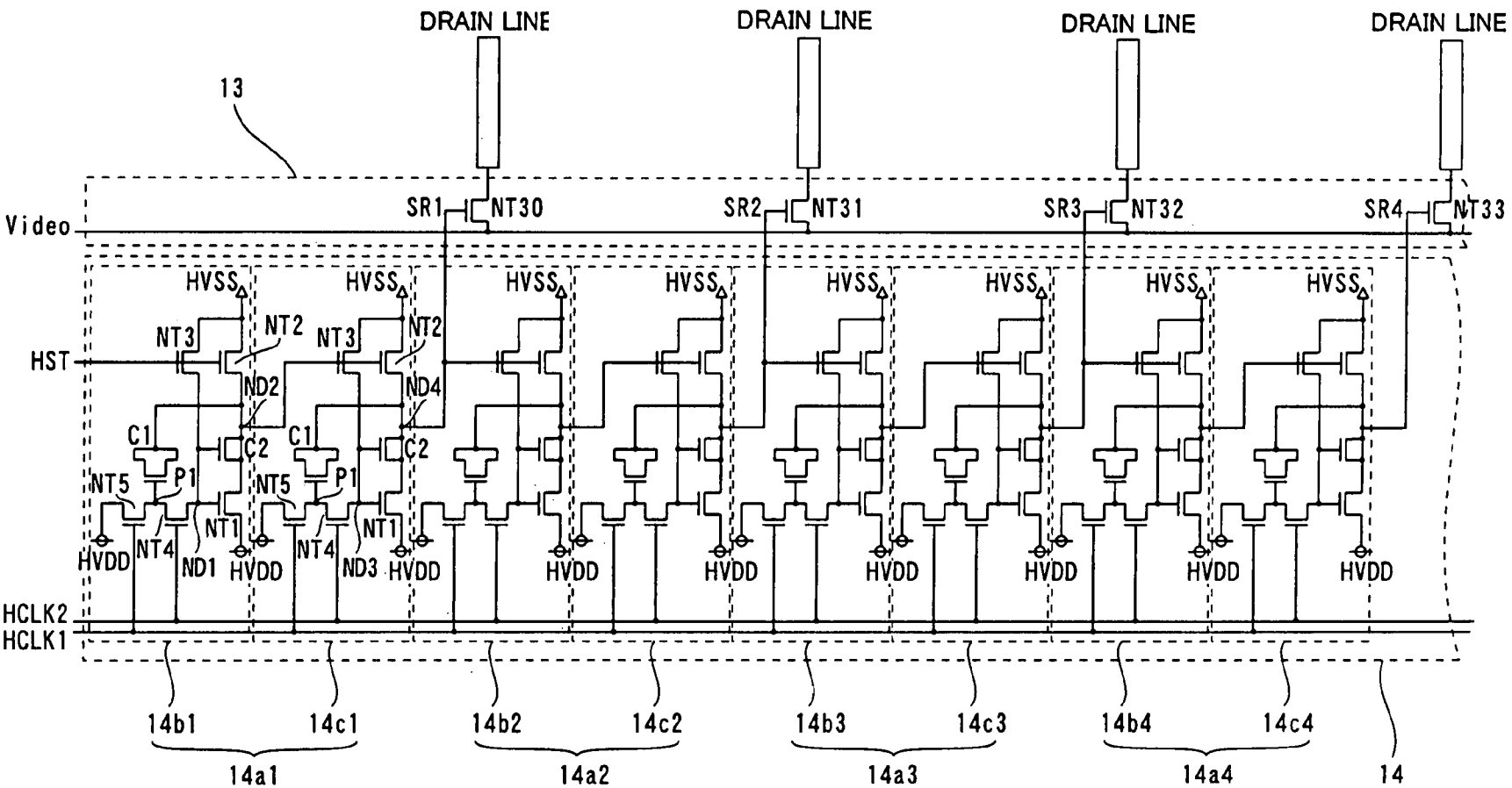
FIG. 7 is a circuit diagram showing a shift register circuit comprising the H driver of the liquid crystal display according to the third embodiment of the invention shown in FIG. 6.

As shown in FIG. 7, the H driver 14 has therein a plurality of stages of shift register circuits 14*a*1, 14*a*2, 14*a*3, 14*a*4. In FIG. 7, only the four stages of the shift register circuits 14*a*1, 14*a*2, 14*a*3, 14*a*4 are shown for simplicity's sake. Actually, the shift registers in the number corresponding to the number of the pixels are arranged. Also, the first-stage shift register circuit 14*a*1 is configured of two first circuit portions 14*b*1, 14*c*1. Also, the shift register circuits 14*a*2, 14*a*3, 14*a*4 in the second to fourth stages are each configured of two first circuit portions 14*b*2, 14*c*2, two first circuit portions 14*b*3, 14*c*3 and two first circuit portions 14*b*4, 14*c*4, respectively. All the first circuit portions 14*b*2, 14*c*2 of the second-stage shift register circuit 14*a*2, the first circuit portions 14*b*3, 14*c*3 of the third-stage shift register circuit 14*a*3 and the first circuit portions 14*b*4, 14*c*4 of the fourth-stage shift register circuit 14*a*4 have a similar circuit configuration to the first circuit portions 14*b*1, 14*c*1 of the first-stage shift register circuit 14*a*1.

The first circuit portions 14*b*1, 14*c*1 of the first-stage shift register circuit 14*a*1 each include five n-channel transistors (n-channel transistors NT1, NT2, NT3, NT4, NT5) and capacitors C1, C2 formed by connecting the source and the drain of the n-channel transistors. The n-channel transistors NT1 to NT5 are hereinafter referred to as the transistors NT1 to NT5, respectively.

According to the third embodiment, the transistors NT1 to NT5 and the transistors comprising the capacitors C1, C2 of the first circuit portions 14*b*1, 14*c*1 are all TFTs (thin-film transistors) formed of n-type MOS transistors (field-effect transistors).

The sources of the transistors NT1, NT3 are connected to the lower voltage supply source HVSS, and the drains of the transistors NT1, NT5 to the higher voltage supply source HVDD. The configuration of the other parts of the shift register circuit 14*a*1 according to the third embodiment is similar to that of the shift register circuit 4*a*1 (FIG. 2) according to the first embodiment.

The horizontal switch 13, as shown in FIG. 17, includes a plurality of transistors NT30, NT31, NT32, NT33. The gates of the transistors NT30, NT31, NT32, NT33 are connected to the outputs SR1, SR2, SR3, SR4, respectively, of the first- to fourth-stage shift register circuits 14*a*1 to 14*a*4. The sources of the transistors NT30 to NT33 are connected to the drain line of the respective stages. The drains of the transistors NT30 to NT33 are connected to a single video signal line Video.

The outputs SR1 to SR4 of the shift register circuits 14*a*1 to 14*a*4 are input to the sources of the horizontal switches 4 in the number corresponding to the number of the video signal lines (three, for example, when three types of video signals of R, G, B are input).

Figure 8:
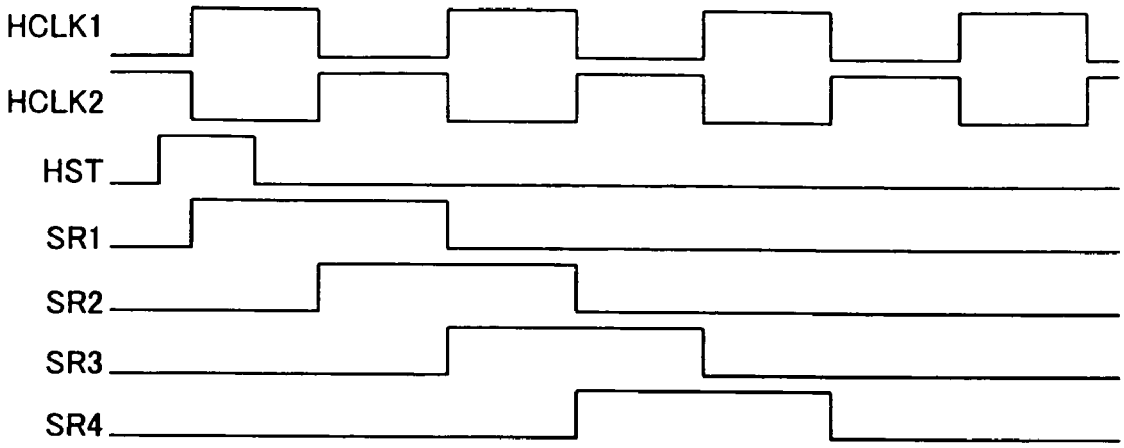
FIG. 8 is a timing chart for a shift register circuit constituting the H driver of the liquid crystal display according to the third embodiment of the invention shown in FIG. 6.

Referring to FIG. 8, the shift register circuit according to the third embodiment is such that the clock signal HCLK1, the clock signal HCLK2 and the start signal HST having waveforms of inverted high and low levels in the timing chart of the shift register circuit according to the first embodiment shown in FIG. 3 are input as a clock signal HCLK1, a clock signal HCLK2 and a start signal HST, respectively. As a result, signals having waveforms with inverted high and low levels of the output signals SR1 to SR4 from the shift register circuit according to the first embodiment shown in FIG. 3 are output form the shift register circuit of the H driver of the liquid crystal display according to the third embodiment. The other operation of the shift register circuit according to the third embodiment is similar to that of the shift register circuit 4*a*1 according to the first embodiment.

The third embodiment having the configuration described above have the effects similar to those of the first embodiment such as the suppression of the increased power consumption of the H driver.

Fourth Embodiment

The fourth embodiment represents a case in which the V driver for driving (scanning) the gate line is configured of n-channel transistors.

Figure 9:
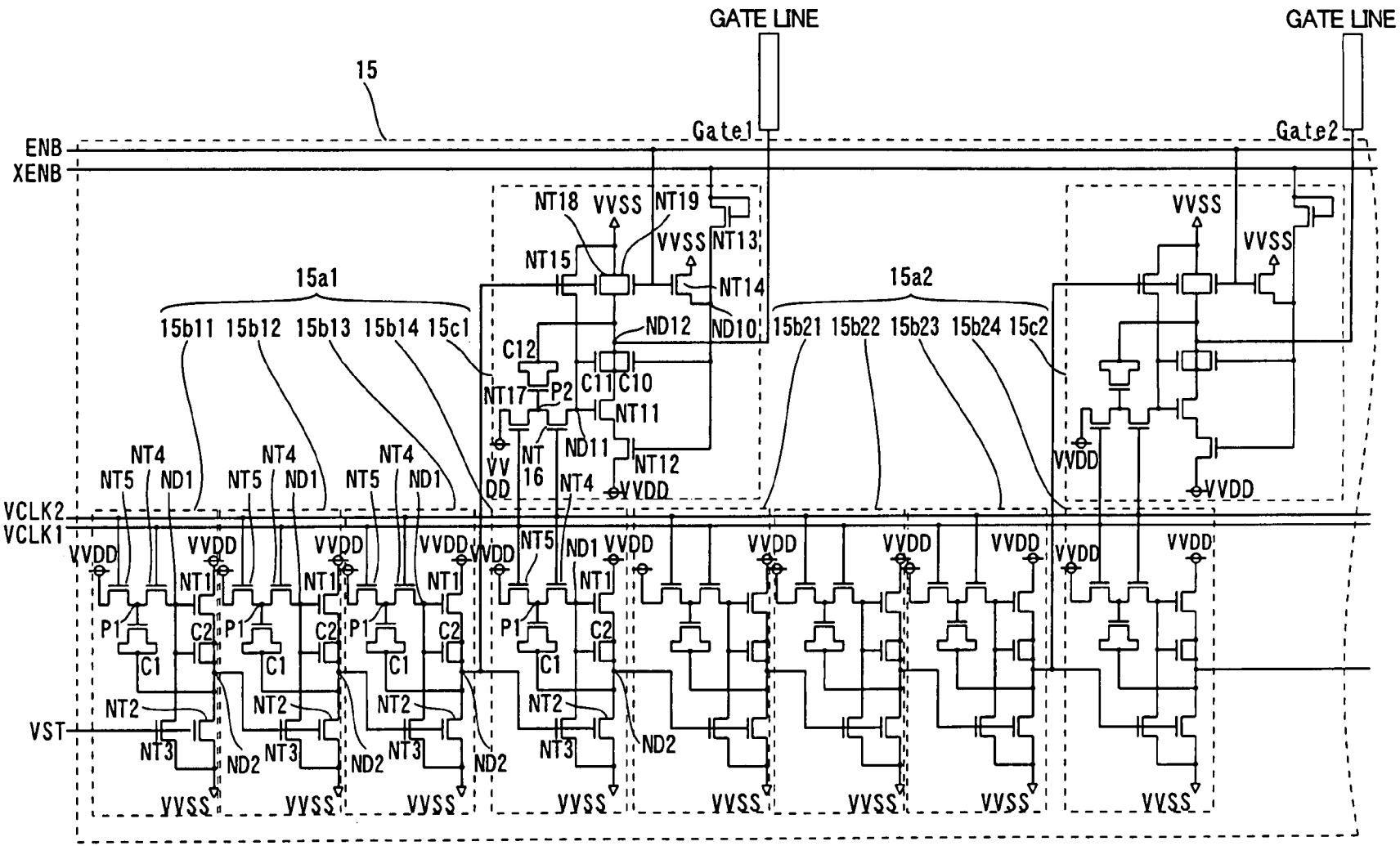
FIG. 9 is a circuit diagram showing a shift register circuit comprising the V driver of the liquid crystal display according to a fourth embodiment of the invention.

In FIG. 9, a plurality of stages of shift register circuits 15*a*1, 15*a*2 are arranged in the V driver 15. FIG. 9 shows only two stages of the shift registers 15*a*1, 15*a*2 for simplicity's sake. The first-stage shift register circuit 15*a*1 is configured of four first circuit portions 15b11, 15b12, 15b13, 15b14 and a second circuit portion 15c1. The second-stage shift register circuit 15a2 is configured of four first circuit portions 15b21, 15b22, 15b23, 15b24 and a second circuit portion 15c2. All of the first circuit portions 15b11, 15b12, 15b13, 15b14 of the first-stage shift register circuit 15a1 and the first circuit portions 15b21, 15b22, 15b23, 15b24 of the second-stage shift register circuit 15a2 have a similar circuit configuration. Also, the second circuit portion 15c1 of the first-stage shift register circuit 15a1 and the second circuit portion 15c2 of the second-stage shift register circuit 15a2 have a similar circuit configuration.

The first circuit portion 15b11 of the first-stage shift register circuit 15a1 includes five n-channel transistors (n-channel transistors NT1, NT2, NT3, NT4, NT5) and capacitors C1, C2 formed by connecting the source and the drain of the n-channel transistors. The second circuit portion 15c1 of the first-stage shift register circuit 15a1 includes nine n-channel transistors (n-channel transistors NT11, NT12, NT13, NT14, NT15, NT16, NT17, NT18, NT19) and capacitors C10, C11, C12 formed by connecting the source and the drain of the n-channel transistors. The n-channel transistors NT18, NT19 have the sources and the drains thereof connected to each other. The n-channel transistors NT11 to NT5 and NT11 to NT19 are hereinafter referred to as the transistors NT1 to NT5 and NT11 to NT19, respectively.

According to the fourth embodiment, the transistors NT1 to NT5, NT11 to NT19 and the transistors comprising the capacitors C1, C2, C10, C11, C12 of the first circuit portions 15b11, 15b12, 15b13, 15b14 and the second circuit portion 15c1 are all TFTs (thin-film transistors) formed of n-type MOS transistors (field-effect transistors).

The other configuration of the shift register circuits 15a1, 15a2 according to the fourth embodiment is similar to that of the shift register circuit 5a1 (FIG. 4) according to the second embodiment.

Figure 10:
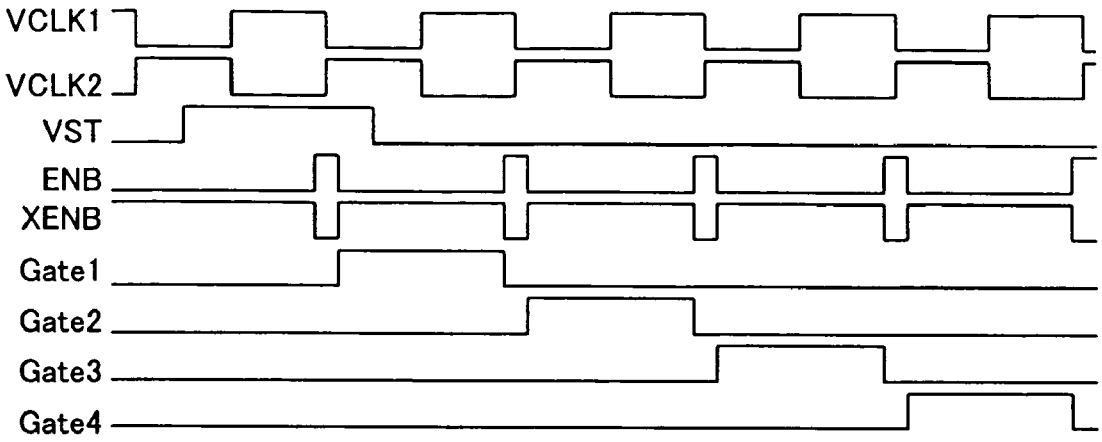
FIG. 10 is a timing chart for the shift register circuit constituting the V driver of the liquid crystal display according to the fourth embodiment shown in FIG. 9.

Reference is made to FIG. 10. The shift register circuit of the V driver according to the fourth embodiment is supplied with a clock signal VCLK1, a clock signal VCLK2, a start signal VST, an ENB signal and a XENB signal which have inverted high and low levels as the clock signal VCLK1, the clock signal CLK2, the start signal VST, the ENB signal and the XENB signal, respectively, in the timing chart of the shift register circuits according to the second embodiment shown in FIG. 5. Signals having a waveform having inverted high and low levels of the output signals Gate1 to Gate4 from the shift register circuits according to the second embodiment shown in FIG. 5 are output from the shift register circuits of the V driver of the liquid crystal display according to the fourth embodiment. The other operation of the shift register circuit according to the fourth embodiment is similar to the operation of the shift register circuit 5a1 according to the second embodiment.

The fourth embodiment having the configuration described above has similar effects to the second embodiment such as the reducing of an increased current consumption of the V driver.

Fifth Embodiment

Figure 11:
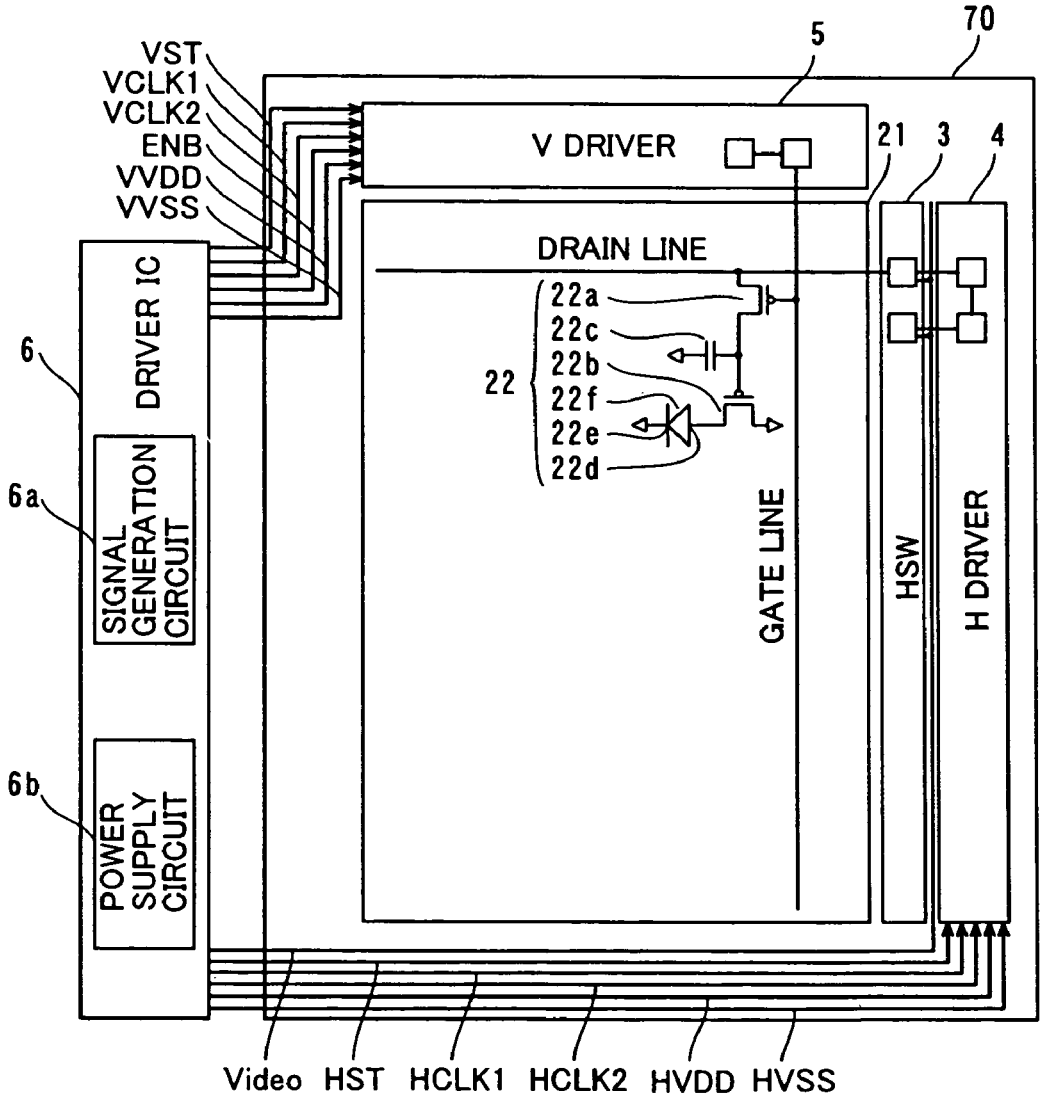
FIG. 11 is a plan view showing an organic EL display according to a fifth embodiment of the invention.

With reference to FIG. 11, an example of the organic EL (electroluminescence) display according to a fifth embodiment of the invention is explained.

The organic EL display according to the fifth embodiment, as shown in FIG. 11, has a display unit 21 arranged on a substrate 70. The display unit 21 shown in FIG. 11 represents the configuration of one pixel. The pixels 22 arranged in matrix on the display unit 21 each include two p-channel transistors 22a, 22b (hereinafter referred to as the transistors 22a, 22b ), a storage capacitor 22c, an anode 22d, a cathode 22e arranged in opposed relation to the anode 22d and an organic EL element 22f held between the anode 22d and the cathode 22e. The gate of the transistor 22a is connected to the gate line. The source of the transistor 22a is connected to the drain line. The drain of the transistor 22a is connected with the storage capacitor 22c and the gate of the transistor 22b. The drain of the transistor 22b is connected with the anode 22d. The internal circuit configuration of the H driver 4 is similar to that of the H driver 4 of the shift register circuit using the transistors shown in FIG. 2. The internal circuit configuration of the V driver 5 is similar to the V driver 5 of the shift register circuit using the transistors shown in FIG. 4. The configuration of the other parts of the organic EL display according to the fifth embodiment is similar to that of the liquid crystal display according to the first embodiment shown in FIG. 1.

The organic EL display according to the fifth embodiment having the configuration described above has similar effects to the first and second embodiments such as the suppression of an increased current consumption of the H driver and the V driver.

Sixth Embodiment

Figure 12:
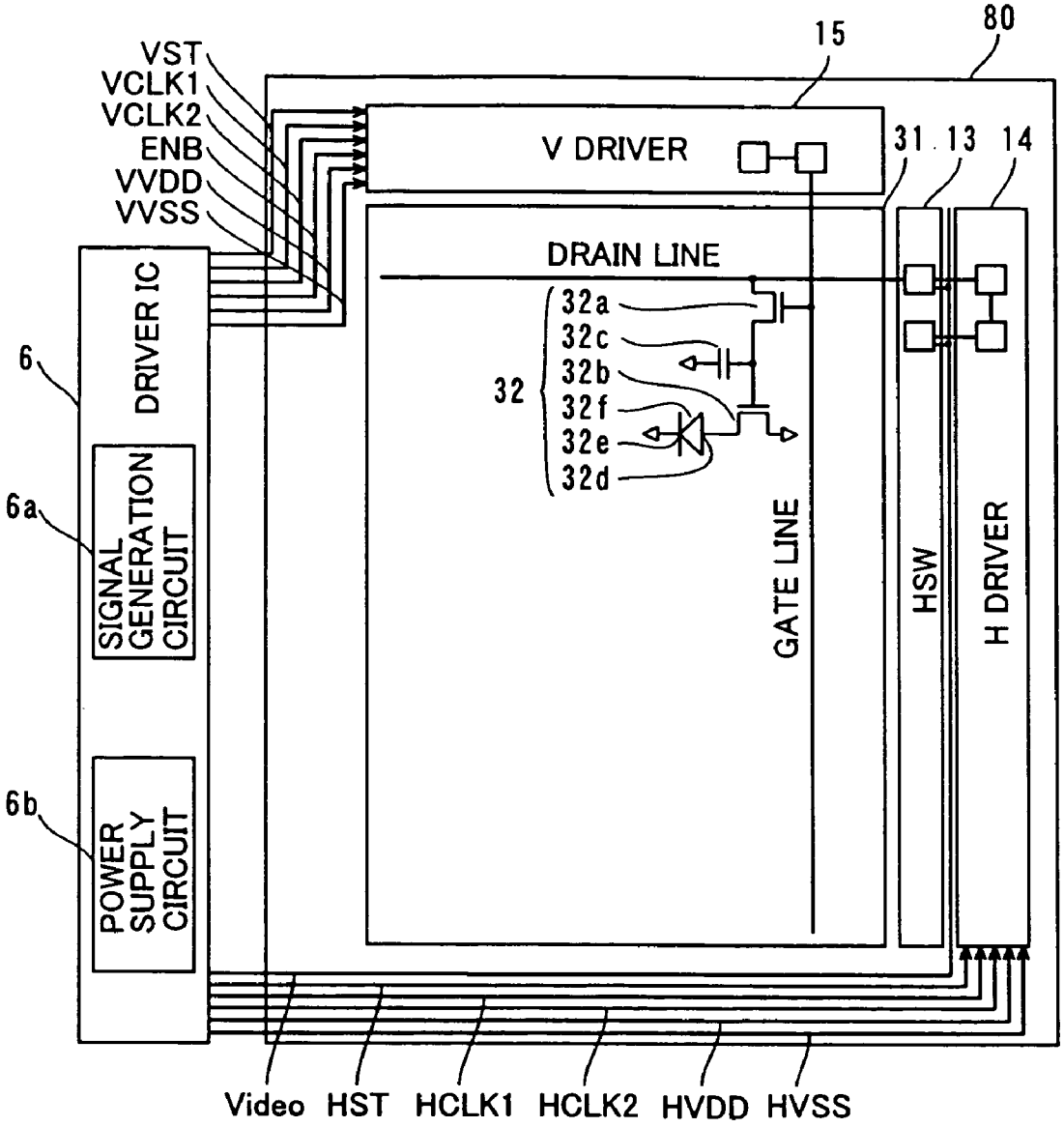
FIG. 12 is a plan view showing an organic EL display according to a sixth embodiment of the invention.
Figure 13:
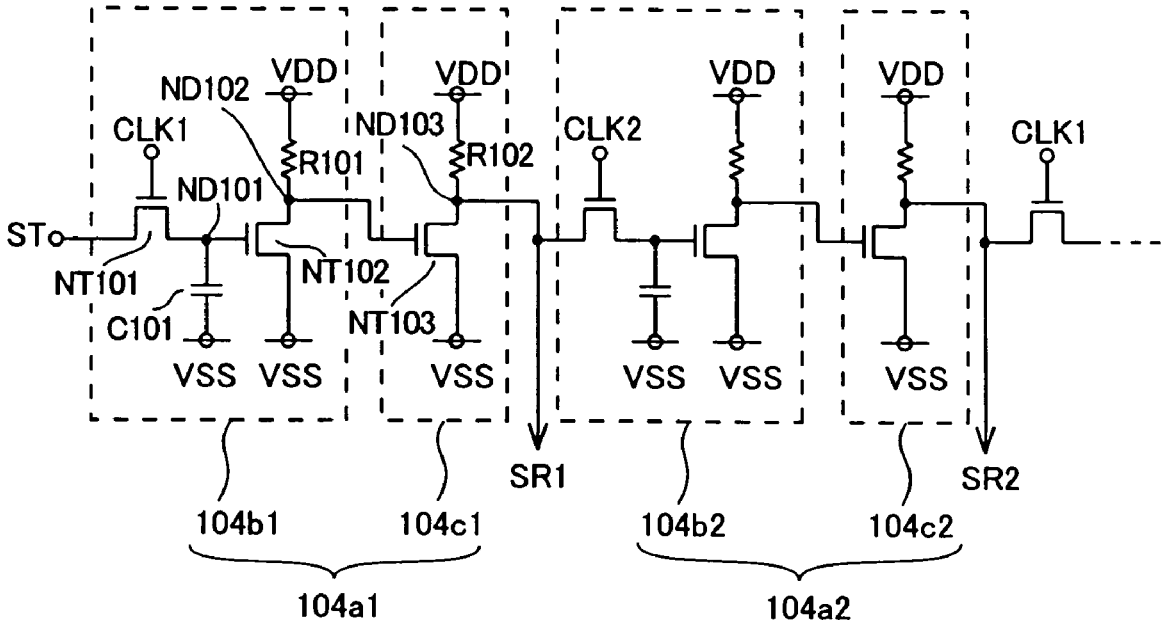
FIG.13 PRIOR ART
FIG. 13 is a circuit diagram showing a conventional shift register circuit having an inverter circuit of resistance load type.
Figure 14:
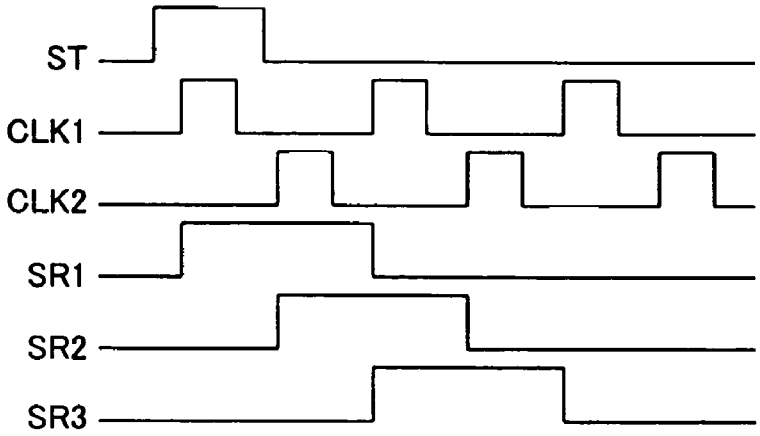
FIG.14 PRIOR ART
FIG. 14 is a timing chart for the conventional shift register circuit shown in FIG. 13.

With reference to FIG. 12, an example of the organic EL display according to a sixth embodiment of the invention is explained.

In the organic EL display according to the sixth embodiment, as shown in FIG. 12, a display unit 31 is arranged on a substrate 80. The display 31 shown in FIG. 12 represents the configuration of one pixel. The pixels 32 arranged in matrix on the display unit 31 each include two n-channel transistors 32a, 32b (hereinafter referred to as the transistors 32a, 32b, respectively), a storage capacitor 32c, an anode 32d and a cathode 32e arranged in opposed relation to the anode 32d and an organic EL element 32f held between the anode 32d and the cathode 32e. The gate of the transistor 32a is connected to the gate line. The drain of the transistor 32a is connected to the drain line. The source of the transistor 32a is connected with the storage capacitor 32c and the gate of the transistor 32b. The source of the transistor 32b is connected with the anode 32d. The internal circuit configuration of the H driver 14 is similar to that of the H driver 14 of the shift register circuits using the transistors shown in FIG. 7. The internal circuit configuration of the V driver 15 is similar to that of the V driver 15 of the shift register circuits using the transistors shown in FIG. 9. The configuration of the other parts of the organic EL display according to the sixth embodiment is similar to that of the liquid crystal display according to the third embodiment shown in FIG. 6.

The organic EL display according to the sixth embodiment having the aforementioned configuration has similar effects to the third and fourth embodiments in that the increase in the current consumption of the H driver and the V driver can be suppressed and otherwise.

The embodiments disclosed herein should be interpreted as illustrative but not limitative in all respects. The scope of this invention is defined not by the foregoing description of the embodiments but by the appended claims and includes all modifications without departing from the spirit and scope of the invention.

Apart from the embodiments described above, for example, the invention is applicable to other displays than the liquid crystal display and the organic EL display with equal effect.

The shift register circuits according to this invention are applicable not only to the first to fourth embodiments but both the H and V drivers of the liquid crystal apparatus. In such a case, the current consumption can be further reduced.

Also, apart from the first embodiment, the transistor PT5 may be turned off when the transistor PT4 is in on state while at the same time turning on the transistor PT5 when the transistor PT4 is in off state, using the signals other than the clock signal and the inverted clock signal.

Also, apart from the first and second embodiment, any potential other than the lower voltage supply sources HVSS and VVSS can be used as the first potential and any potential other than higher voltage supply sources HVDD and VVDD can be used as the second potential, as long as the second potential is higher than the first potential.

Also, apart from the third and fourth embodiment, any potential other than the higher voltage supply sources HVDD and VVDD can be used as the first potential and any potential other than lower voltage supply sources HVSS and VVSS can be used as the second potential, as long as the second potential is lower than the first potential.

What is claimed is:

1. A display comprising a shift register circuit formed by connecting a plurality of first circuit portions each having:

a first conductive type first transistor connected to a first potential;

a first conductive type second transistor connected to a constant second potential;

a first conductive type third transistor with the gate thereof connected to the gate of said second transistor, connected between the gate of said first transistor and said second potential;

a first conductive type fourth transistor connected to the gate of said first transistor and turned on in response to a first clock signal;

a first conductive type fifth transistor, with the drain thereof connected to the source of said fourth transistor, connected between said fourth transistor and said first potential and turned off in response to a second clock signal when said first clock signal is for turning on said fourth transistor, wherein said second clock signal is an inverted clock signal of said first clock signal; and a first capacitor, in which said first potential is accumulated when said fifth transistor is in on state, is connected between the source of said first transistor and the junction point of the source of said fourth transistor and the drain of said fifth transistor, wherein said second clock signal of a potential for turning off said fifth transistor is input to the gate of said fifth transistor, thereby said fifth transistor is turned off when said fourth transistor is turned on by said first clock signal of a potential for turning on said fourth transistor input to the gate of said fourth transistor, wherein said first clock signal of a potential for turning off said fourth transistor is input to the gate of said fourth transistor, thereby the said fourth transistor is turned off when said fifth transistor is turned on by said second clock signal of a potential for turning on said fifth transistor input to the gate of said fifth transistor, and wherein an output signal of a start signal or a preceding stage of a shift register circuit is input to the gates of said second transistor and said third transistor.

2. The display according to claim 1, wherein at least said first transistor, said second transistor, said third transistor, said fourth transistor and said fifth transistor are each a p-type field-effect transistor.

3. The display according to claim 1, wherein said shift register circuit is used as at least one of a shift register circuit for driving the drain line and a shift register circuit for driving the gate line.

4. The display according to claim 3, wherein said drain line driven by said shift register circuit is connected with a pixel including one of a liquid crystal and an EL element.

* * * * *